US010349467B2

(12) United States Patent
Hoffmann et al.

(10) Patent No.: US 10,349,467 B2
(45) Date of Patent: Jul. 9, 2019

(54) COOKING HOB WITH A BALANCE SYSTEM AND A METHOD FOR ADJUSTING THE TEMPERATURE OF A COOKING VESSEL

(75) Inventors: Harald Hoffmann, Rothenburg (DE); Richard Turek, Furth (DE)

(73) Assignee: Electrolux Home Products Corporation N.V., Brussels (BE)

( * ) Notice: Subject to any disclaimer, the term of this patent is extended or adjusted under 35 U.S.C. 154(b) by 1230 days.

(21) Appl. No.: 13/825,166

(22) PCT Filed: Sep. 20, 2011

(86) PCT No.: PCT/EP2011/066254

§ 371 (c)(1),
(2), (4) Date: Jun. 14, 2013

(87) PCT Pub. No.: WO2012/048990

PCT Pub. Date: Apr. 19, 2012

(65) Prior Publication Data

US 2013/0248516 A1 Sep. 26, 2013

(30) Foreign Application Priority Data

Oct. 14, 2010 (EP) ..... 10013667.0

(51) Int. Cl.
*H05B 1/02* (2006.01)
*H05B 6/06* (2006.01)
*H05B 6/12* (2006.01)

(52) U.S. Cl.
CPC ..... *H05B 1/0266* (2013.01); *H05B 6/062* (2013.01); *H05B 6/1209* (2013.01); *H05B 2213/07* (2013.01)

(58) Field of Classification Search
CPC ..... G05B 2219/31004; H02J 7/0004; H02J 7/0021; H02J 7/0026; H02J 7/0027;
(Continued)

(56) References Cited

U.S. PATENT DOCUMENTS 6,018,152 A 1/2000 allaire et al.
6,184,501 B1 * 2/2001 Zapf ..... H05B 3/746 219/447.1

(Continued)

FOREIGN PATENT DOCUMENTS

DE 10156777 * 5/2003
ES 2339087 5/2010

OTHER PUBLICATIONS

International Search Report and Written Opinion issued in PCT Application PCT/US2011/039168 dated Feb. 9, 2012, 14 pages.

(Continued)

*Primary Examiner* — Dana Ross
*Assistant Examiner* — Joseph W Iskra
(74) *Attorney, Agent, or Firm* — Pearne & Gordon LLP

(57) ABSTRACT

The present invention relates to a cooking hob (10) including at least two cooking zones (16, 18) and a balance system for adjusting the temperature of a cooking vessel (20) after said cooking vessel (20) has been moved from a first cooking zone (16) to a second cooking zone (18). The cooking zones (16, 18) comprise or correspond with a vessel recognition device in each case. The cooking hob (10) includes a sensor device for detecting the temperature of the first cooking zone (16). The balance system is provided for activating a boosted power level (30) at the second cooking zone (18) for an estimated time in order to compensate the energy loss (Qs) of the cooking vessel (20) during setting said cooking vessel (20) on the second cooking zone (18). The boosted power level (30) is estimated on the basis of a pre-set power level (28) of the second cooking zone (18), the temperature of the first cooking zone (16) before the cooking vessel (20) has been set on the second cooking zone (18) and an estimated time for activating the boosted power level (30). Further, the present invention relates to a method for adjusting the temperature of a cooking vessel (20) on a (Continued)

Figure 1:
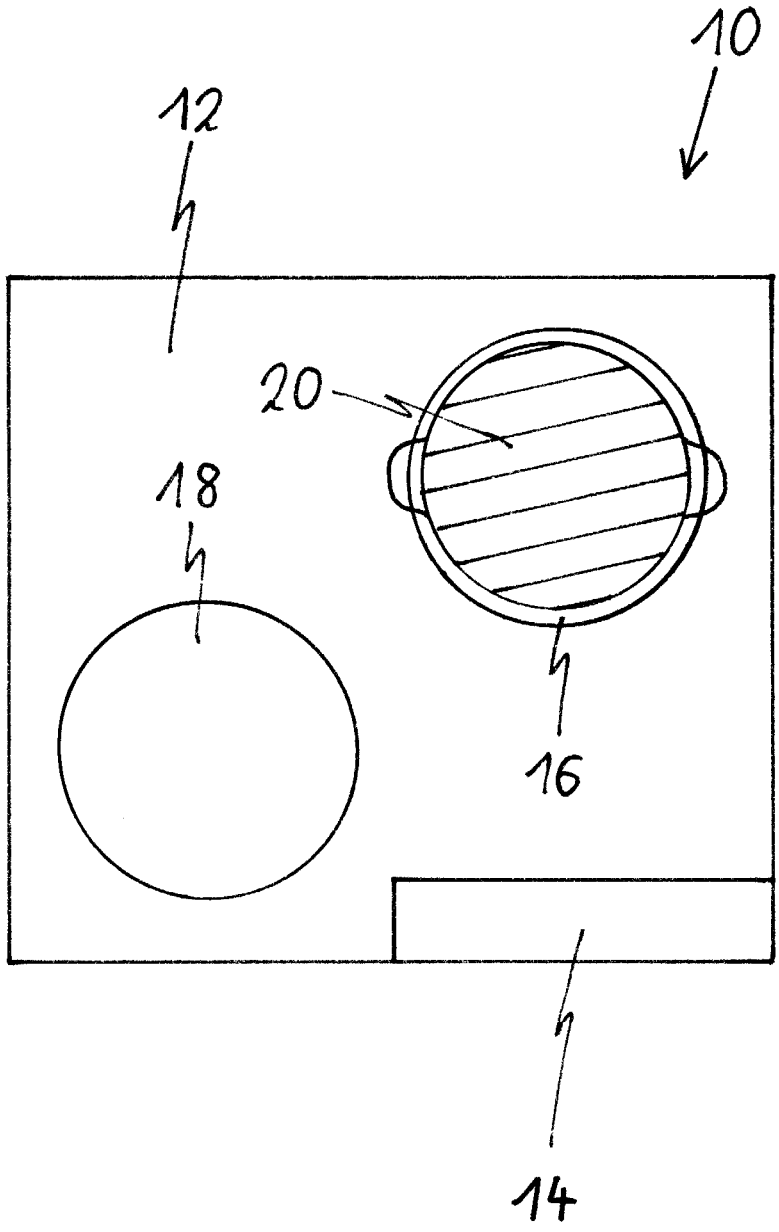

cooking hob (10), after said cooking vessel has been moved from one cooking zone (16) to another cooking zone (18).

7 Claims, 2 Drawing Sheets

(58) Field of Classification Search
CPC .. H05B 1/0266; H05B 2213/07; H05B 6/062; H05B 6/1209
USPC ..... 219/200, 494, 497, 600, 618, 620, 621, 219/622, 625, 626, 627, 663–667, 219/702–720; 99/324, 325, 451; 340/572.1
See application file for complete search history.

(56) References Cited

U.S. PATENT DOCUMENTS 6,903,311 B2 * 6/2005 Tembe ..... H05B 3/74 219/412
6,953,919 B2 * 10/2005 Clothier ..... H05B 6/062 219/494
7,087,876 B2 8/2006 Petrenko
8,420,984 B2 * 4/2013 Kaiser ..... 219/448.12
8,569,666 B2 * 10/2013 Gutierrez ..... H05B 6/065 219/620
2002/0117497 A1 * 8/2002 Bassill ..... H05B 6/062 219/626
2002/0118550 A1 8/2002 Petrenko et al.
2003/0006652 A1 1/2003 Couture
2003/0178416 A1 * 9/2003 Fujii ..... H05B 6/062 219/621
2004/0065458 A1 4/2004 Hansen
2004/0149736 A1 8/2004 Clothier
2005/0247696 A1 * 11/2005 Clothier ..... H05B 3/746 219/497
2007/0125768 A1 * 6/2007 Kim ..... H05B 6/062 219/626
2007/0230987 A1 * 10/2007 Yamashita ..... H05B 6/04 399/88
2010/0114339 A1 * 5/2010 Kaiser ..... H05B 3/746 700/90

OTHER PUBLICATIONS

International Search Report for PCT/EP2011/066254, dated Mar. 7, 2012, 2 pages.

* cited by examiner

COOKING HOB WITH A BALANCE SYSTEM AND A METHOD FOR ADJUSTING THE TEMPERATURE OF A COOKING VESSEL

The present invention relates to a cooking hob with a balance system for adjusting the temperature of a cooking vessel, after said cooking vessel has been moved from one cooking zone to another cooking zone. Further, the present invention relates to a method for adjusting the temperature of a cooking vessel on a cooking hob, after said cooking vessel has been moved from one cooking zone to another cooking zone.

During the cooking procedure there are situations, in which it would be expedient, if a cooking vessel can be moved to another cooking zone. For example, when the food stuff has to be stirred within the cooking vessel, then it is advantageous that said cooking vessel is arranged on a front cooking zone. However, when said food stuff need not be stirred again in another cooking phase and the front cooking zones are required for other cooking vessels, then the cooking vessel should be moved to a rear cooking zone. Arriving at the rear cooking zone the cooking vessel transmits a part of its energy to said rear cooking zone. Thus, the cooking vessel gets colder, although the cooking temperature should be stable. It takes a long time for obtaining the former cooking temperature again. If the cooking process ends after a calculated cooking time, then the food stuff ends is not cooked. In order to avoid this, the user has to boost the power level or to enlarge the cooking time.

DE 101 56 777 A1 discloses a cooking hob with a control unit. Said control unit allows that the setting data are transferred from one cooking zone to another cooking zone, after a cooking vessel has been moved from said one cooking zone to the other cooking zone. An automatic boost function may be activated after the movement of the cooking vessel in order to increase the power level for a predetermined time. However, only the setting data of the one cooking zone can be transferred to the other cooking zone. It is not possible to adjust different power levels for the both cooking zone.

It is an object of the present invention to provide a cooking hob and a corresponding method, which allows the movement of the cooking vessel from one cooking zone to another cooking zone, wherein said cooking vessel can be kept at a continuous temperature sequence.

The object of the present invention is achieved by the induction cooking hob according to claim 1.

According to the present invention the cooking hob includes at least two cooking zones and a balance system for adjusting the temperature of a cooking vessel after said cooking vessel has been moved from a first cooking zone to a second cooking zone, wherein:

- the cooking zones comprise or correspond with a vessel recognition device in each case,
- the cooking hob includes a sensor device for detecting the temperature of the first cooking zone,
- the balance system is provided for activating a boosted power level at the second cooking zone for an estimated time in order to compensate the energy loss of the cooking vessel during setting said cooking vessel on the second cooking zone, and
- the boosted power level is estimated on the basis of a preset power level of the second cooking zone, the temperature of the second cooking zone before the cooking vessel has been set on the second cooking zone and an estimated time for activating the boosted power level.

The main idea of the present invention is the estimation of the boosted power level on the basis of the pre-set power level, the temperature of the first cooking zone and the estimated time for activating the boosted power level, so that the cooking vessel is kept at a continuous temperature sequence. The cooking process is not disturbed by moving the cooking vessel from the first cooking zone to the second cooking zone. The temperature in the cooking vessel keeps stable. It is not necessary, that the user has to adjust manually the pre-set power level or to enlarge the time for cooking process.

According to a preferred embodiment of the present invention the cooking hob includes a sensor device for detecting the temperature of the second cooking zone. Thus, a further parameter can be considered for the estimation of the boosted power level.

Further, the cooking hob may include an electronic control unit for controlling the balance system. The electronic control unit allows a fast and reliable control of the cooking hob.

For example, the vessel recognition device may comprise inductive and/or capacitive elements. The inductive and capacitive elements allow low complexity.

Alternatively or additionally, the vessel recognition device may comprise at least one camera. In this case, only one camera would be sufficient for the whole cooking area.

The object of the present invention is further achieved by the method according to claim 6.

According to the present invention the method for controlling a balance system for adjusting the temperature of a cooking vessel after said cooking vessel has been moved from a first cooking zone to a second cooking zone of a cooking hob, comprises the steps of:

- detecting the presence of the cooking vessel on the first cooking zone and the second cooking zone,
- detecting the temperature of the first cooking zone, and
- activating a boosted power level at the second cooking zone for an estimated time in order to compensate the energy loss of the cooking vessel during setting said cooking vessel on the second cooking zone, wherein
- the boosted power level is estimated on the basis of a preset power level of the second cooking zone, the temperature of the second cooking zone before the cooking vessel has been set on the second cooking zone and an estimated time for activating the boosted power level.

The present invention allows the estimation of the boosted power level on the basis of the pre-set power level, the temperature of the first cooking zone and the estimated time for activating the boosted power level, so that the cooking vessel is kept at a continuous temperature sequence. The cooking vessel can be moved from the first cooking zone to the second cooking zone without disturbing the cooking process.

In particular, the cooking vessel is kept at a continuous temperature sequence before, during and after the movement from the first cooking zone to the second cooking zone.

Additionally, the temperature of the second cooking zone may be detected.

Preferably, the balance system is controlled by an electronic control unit.

For example, the estimated time for activating a boosted power level is about four seconds.

Further, a factor for each boosted power level lower than a maximum boosted power level is defined. In particular, the factor depends on the pre-set power level of the second cooking zone, the temperature of the second cooking zone before the cooking vessel has been set on it and the estimated time for activating the boosted power level.

Novel and inventive features of the present invention are set forth in the appended claims.

Figure 2:
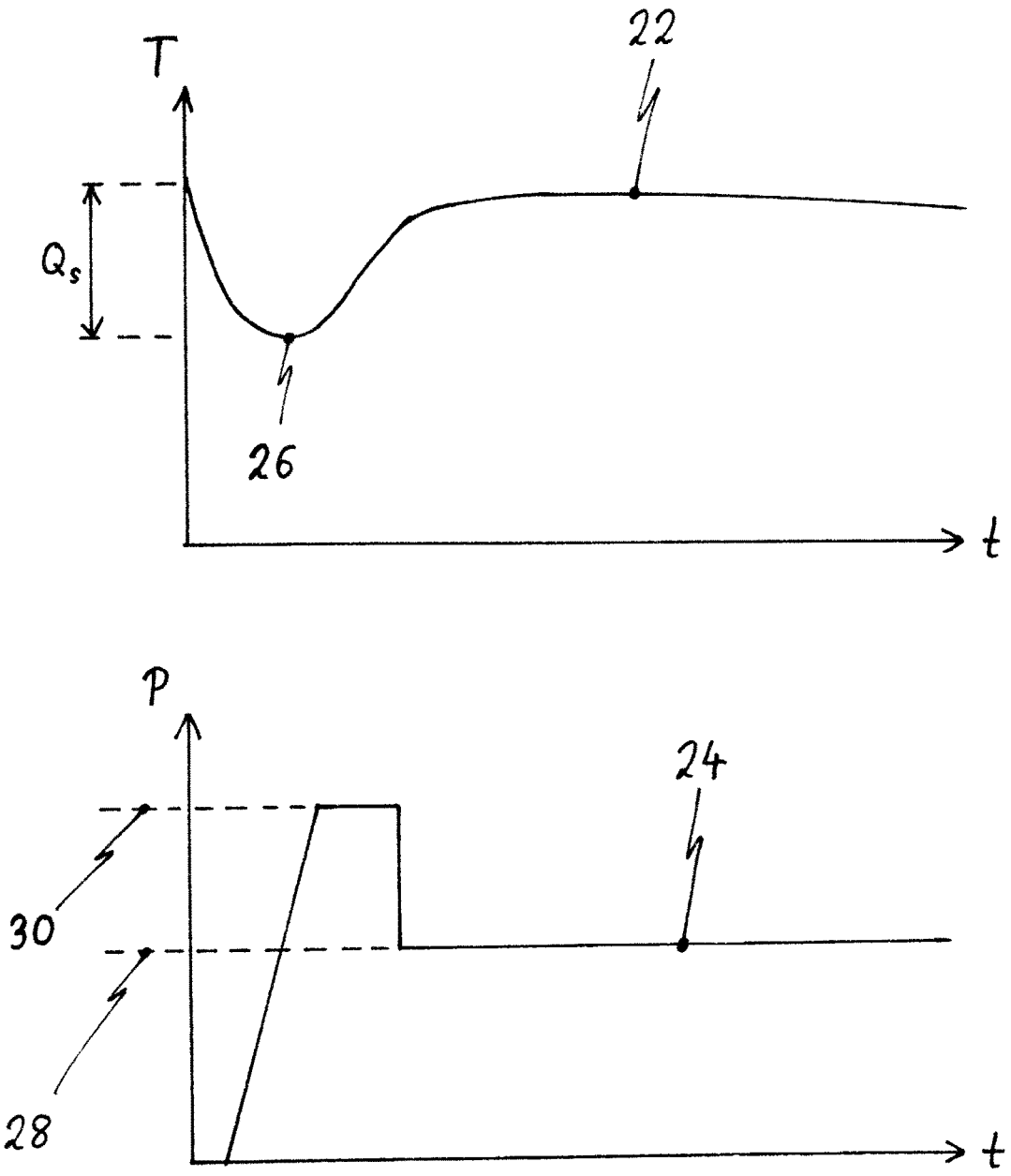

The present invention will be described in further detail with reference to the drawings, in which FIG. 1 illustrates a schematic top view of a cooking hob according to a preferred embodiment of the present invention, and FIG. 2 illustrates schematic diagrams of the temperature and the power as a function of time according to the preferred embodiment of the present invention.

FIG. 1 illustrates a schematic top view of a cooking hob 10 according to a preferred embodiment of the present invention. The cooking hob 10 includes a cooking area 12 and a control area 14.

The cooking area 12 comprises radiant and/or induction heating elements.

The cooking area 12 comprises a first cooking zone 16 and a second cooking zone 18. The cooking area 12 may comprise further cooking zones, which are not shown in FIG. 1. A cooking vessel 20 is arranged on the first cooking zone 16. The first cooking zone 16 is activated. The second cooking zone 18 is in a standby mode. Further, the cooking hob 10 includes an electronic control unit, which is not shown in FIG. 1.

The cooking zones 16 and 18 comprise or correspond with a vessel recognition device in each case. Said vessel recognition device is provided for detecting, if the cooking vessel 20 is arranged on the corresponding cooking zone 16 or 18, respectively. Further, the cooking zones 16 and 18 comprise a temperature sensor in each case. Said temperature sensor is provided for detecting the temperature of the corresponding cooking zone 16 or 18, respectively.

When the cooking vessel 20 is moved from the first cooking zone 16 to the second cooking zone 18, there is a heat transfer from the cooking vessel 20 to the second cooking zone 18. The cooking vessel 20 losses heat energy, and the second cooking zone 18 is heated up.

In order to avoid that the cooking vessel 20 cools down, the power level of the second cooking zone 18 is boosted for a predetermined time. A boosted power level 30 depends on the temperature of the first cooking zone 16, a pre-set power level of the second cooking zone 18 and said predetermined time. Additionally, the boosted power level 30 may depend on a detected temperature of the second cooking zone 18 and/or an estimated residual heat of the second cooking zone 18.

For example, the predetermined time has a fixed value, wherein the boosted power level 30 is variable. The boosted power level 30 is activated only then, if a cooking vessel is detected on the second cooking zone 18 within a defined time range, after the cooking vessel 20 has been removed from the first cooking zone 16.

Further, a time factor for the predetermined time is defined, if the boosted power level is lower than a maximum value. Said time factor depends on the time for setting the second cooking zone 18 on the boosted power level, the temperature of the second cooking zone 18, before the cooking vessel 20 is moved on it, and a pre-set power level 28.

FIG. 2 illustrates schematic diagrams 22 and 24 of the temperature T and the power P as a function of time t according to the preferred embodiment of the present invention.

The diagram 22 relates to the temperature T of the cooking vessel 20, after said cooking vessel 20 has been moved to the second cooking zone 18. The function of the temperature T develops a bump 26, after the cooking vessel 20 has been set on the second cooking zone 18. The bump 26 corresponds with an energy loss QS of the cooking vessel 20 after setting on the second cooking zone 18. A few seconds later the temperature T reaches its initial value again.

The diagram 24 relates to the power P of the second cooking zone 18. After the cooking vessel 20 has been set on the second cooking zone 18, the power P increases until the boosted power level 30 has been reached. Then, the boosted power level 30 is maintained for the predetermined time. After said predetermined time the power P is reduced to the pre-set power level 28 again.

For example, water in the cooking vessel 20 arranged on the first cooking zone 16 starts to boil. Then noodles are put into the cooking vessel 20, and said cooking vessel 20 is moved to the second cooking zone 18, wherein the pre-set power level 28 of the second cooking zone 18 is set on a smart boiling level. Without the boosted power level 30 the water would stop to boil and the time for cooking the noodle should be enlarged. The boosted power level 30 may be activated for about four seconds. Afterwards the power of the second cooking zone 18 is reduced to the pre-set power level 28 again. Now, the water with the noodles can boil on the smart level and keep its temperature.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking hob
12 cooking area
14 control area
16 first cooking zone
18 second cooking zone
20 cooking vessel
22 diagram of the temperature T
24 diagram of the power P
26 bump
28 pre-set power level
30 boosted power level
t time
temperature
P power
$Q_s$ energy loss

The invention claimed is:

1. A method for adjusting the temperature of a cooking vessel after said cooking vessel has been moved from a first cooking zone to a second cooking zone of a cooking hob, wherein the method comprises steps of:

detecting, by a vessel recognition device, the presence of the cooking vessel on the first cooking zone and the second cooking zone;

detecting, by a temperature sensor, the temperature of the first cooking zone, and activating, by an electronic control unit, a boosted power level at the second cooking zone for a pre-determined time in order to compensate the energy loss (Qs) of the cooking vessel when said cooking vessel is moved from the first cooking zone to the second cooking zone, wherein the boosted power level is selected on the basis of a pre-set power level of the second cooking zone, the temperature of the first cooking zone, a temperature of the second cooking zone before the cooking vessel has been set on the second cooking zone, and the pre-determined time for activating the boosted power level.

2. The method according to claim 1, characterized in that the cooking vessel is kept at a continuous temperature sequence before, during and after the movement from the first cooking zone to the second cooking zone.

3. The method according to claim 1, characterized in that the temperature of the second cooking zone is detected.

4. The method according to claim 1, characterized in that the pre-determined time for activating the boosted power level is about four seconds.

5. The method according to claim 1, characterized in that a factor for each boosted power level lower than a maximum boosted power level is defined.

6. The method according to claim 5, characterized in that the factor depends on the pre-set power level of the second cooking zone, the temperature of the second cooking zone before the cooking vessel has been set on it and the pre-determined time for activating the boosted power level.

7. The method according to claim 1, wherein the cooking vessel has an initial temperature value right before being removed from the first cooking zone, and during the step of activing the boosted power level for the pre-determined time, the temperature of the vessel is increased to the initial temperature value without exceeding the initial temperature value.

* * * * *